US007192467B2

(12) United States Patent
Khan et al.

(10) Patent No.: US 7,192,467 B2
(45) **Date of Patent: *Mar. 20, 2007**

(54) METHOD FOR PRODUCING MOLYBDENUM METAL AND MOLYBDENUM METAL

(75) Inventors: Mohamed Khan, Tucson, AZ (US); Joel Taube, Donnellson, IA (US); Loyal M. Johnson, Jr., Tucson, AZ (US)

(73) Assignee: Climax Engineered Materials, LLC, Phoenix, AZ (US)

( * ) Notice: Subject to any disclaimer, the term of this patent is extended or adjusted under 35 U.S.C. 154(b) by 518 days.

This patent is subject to a terminal disclaimer.

(21) Appl. No.: 10/719,234

(22) Filed: Nov. 20, 2003

(65) Prior Publication Data

US 2004/0112176 A1 Jun. 17, 2004

Related U.S. Application Data

(60) Continuation-in-part of application No. 10/464,324, filed on Jun. 18, 2003, now Pat. No. 7,132,005, which is a division of application No. 10/045,637, filed on Nov. 6, 2001, now Pat. No. 6,626,976.

(51) Int. Cl.
*B22F 9/22* (2006.01)

(52) U.S. Cl. ..... 75/369; 75/363; 75/623

(58) Field of Classification Search ..... 75/369, 75/363, 623

See application file for complete search history.

(56) References Cited

U.S. PATENT DOCUMENTS

| | | | |
|---|---|---|---|
| 2,398,114 A | 4/1946 | Rennie | |
| 2,402,084 A | 6/1946 | Rennie | |
| 3,264,098 A | 8/1966 | Heytmeijer | |
| 3,865,573 A | 2/1975 | Neumann et al. | |
| 4,045,216 A | 8/1977 | Meyer et al. | |
| 4,547,220 A | 10/1985 | Carpenter et al. | |
| 4,595,412 A | 6/1986 | Brunelli et al. | |
| 5,330,557 A | 7/1994 | May | |
| 6,626,976 B2 * | 9/2003 | Khan et al. | 75/369 |
| 2001/0049981 A1 | 12/2001 | Mccormick | |

FOREIGN PATENT DOCUMENTS

| | | |
|---|---|---|
| DE | 74082 A | 6/1970 |
| EP | 1162281 A1 | 12/2001 |
| GB | 932 168 A | 7/1963 |
| WO | WO 98/24576 | 6/1998 |

OTHER PUBLICATIONS

European Patent Office, European Search Report, Application No. EP 02 02 2649, Examiner M. Alvazzi Delfrate, Jan. 21, 2003.

Studies in Inorganic Chemistry 19 "Molybdenum: An Outline of its Chemistry and Uses" by E. R. Braithwaite and J. Haber, 1994. pp. 14-15, 20-26, 58-68, 147, 148, 150, Dec. 1994.

* cited by examiner

*Primary Examiner*—Scott Kastler
(74) *Attorney, Agent, or Firm*—Fennemore Craig, P.C.; Bruce E. Dahl; Susan E. Chetlin

(57) ABSTRACT

Novel forms of molybdenum metal, and apparatus and methods for production thereof. Novel forms of molybdenum metal are preferably characterized by a surface area of substantially about 2.1 $m^2/g$ to substantially about 4.1 $m^2/g$. Novel forms of molybdenum metal are also preferably characterized by a relatively uniform size.

14 Claims, 5 Drawing Sheets

METHOD FOR PRODUCING MOLYBDENUM METAL AND MOLYBDENUM METAL

CROSS-REFERENCE TO RELATED APPLICATION

This is a continuation-in-part of U.S. patent application Ser. No. 10/464,324 filed on Jun. 18, 2003, now U.S. Pat. No. 7,132,005 which is a divisional of application Ser. No. 10/045,637 filed on Nov. 6, 2001 application of U.S. Pat. No. 6,626,976, which are hereby incorporated herein by reference for all that they disclose.

FIELD OF THE INVENTION

The invention generally pertains to molybdenum, and more specifically, to molybdenum metal and production thereof.

BACKGROUND OF THE INVENTION

Molybdenum (Mo) is a silvery or platinum colored metallic chemical element that is hard, malleable, ductile, and has a high melting point, among other desirable properties. Thus, molybdenum is commonly used as an additive for metal alloys to impart various properties thereto, and hence to enhance the properties of the metal alloy. For example, molybdenum may be used as a hardening agent, especially for high-temperature applications. However, molybdenum does not naturally occur in pure form. Instead, molybdenum occurs in a combined state. For example, molybdenum ore typically exists as molybdenite (molybdenum disulfide, $MoS_2$). The molybdenum ore may then be processed by roasting it to form molybdic oxide, $MoO_3$.

Molybdic oxide may be directly combined with other metals, such as steel and iron, to form alloys thereof, or molybdic oxide may be further processed to form pure molybdenum. In its pure state, molybdenum metal is tough and ductile and is characterized by moderate hardness, high thermal conductivity, high resistance to corrosion, and a low expansion coefficient. Therefore, molybdenum metal may be used for electrodes in electrically heated glass furnaces, nuclear energy applications, and for casting parts used in missiles, rockets, and aircraft. Molybdenum metal may also be used as a filament material in various electrical applications that are subject to high temperatures, such as X-ray tubes, electronic tubes, and electric furnaces. In addition, molybdenum metal is often used as a catalyst (e.g., in petroleum refining), among other uses or applications.

Processes have been developed for producing molybdenum metal in its pure state. Such a process involves a two-step process. In the first step, a mixture of molybdenum tri-oxide and ammonium di-molybdate is introduced to a first furnace (e.g., a rotary kiln or fluidized bed furnace) to yield molybdenum dioxide, as expressed by the following formula:

$$2(NH_4)MoO_4+2MoO_3 \rightarrow 3MoO_2+4H_2O+N_2(g) \quad (1)$$

In the second step, the molybdenum dioxide is transferred to a second furnace (e.g., a pusher furnace) and reacted with hydrogen to form molybdenum powder, for example, as expressed by the following formula:

$$MoO_2+2H_2(g) \rightarrow Mo+2H_2O \quad (2)$$

However, this process for producing molybdenum metal requires multiple batch steps, which is labor intensive, slows production, and increases production costs. In addition, this process requires separate processing equipment (e.g., furnaces) for each step, which increases capital costs and maintenance costs. Furthermore, these processes only produce molybdenum metal having a surface area of about 0.8 square meters per gram ($m^2/g$), or less, and may vary widely in size.

SUMMARY OF THE INVENTION

Novel forms of molybdenum metal may be characterized by a surface area of substantially about 2.1 $m^2/g$ to substantially about 4.1 $m^2/g$ according to BET analysis. Other novel forms of molybdenum metal may be characterized by a substantially uniform size as detected by scanning electron microscopy.

BRIEF DESCRIPTION OF THE DRAWINGS

Illustrative and presently preferred embodiments of the invention are illustrated in the drawings, in which.

DESCRIPTION OF THE PREFERRED EMBODIMENT

Figure 1:
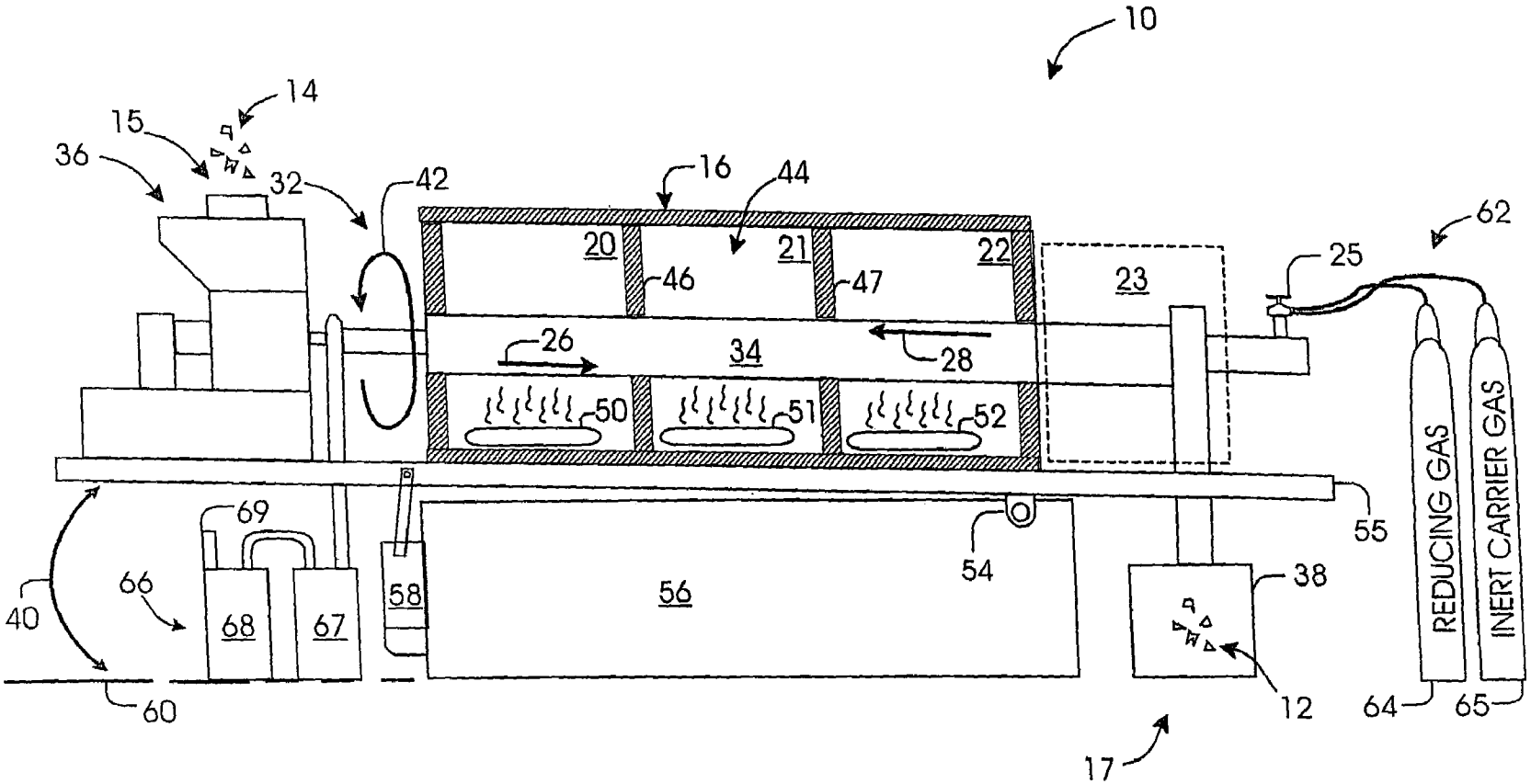
FIG. 1 is a cross-sectional schematic representation of one embodiment of apparatus for producing molybdenum metal according to the invention.

Apparatus 10 (FIG. 1) is shown and described herein as it may be used to produce molybdenum metal 12. Briefly, molybdenum metal does not occur naturally, but rather it occurs in a combined state, such as in an ore. Molybdenum ore may be processed to form molybdic oxide ($MoO_3$), which may be further processed in the presence of ammonium di-molybdate and hydrogen to form pure molybdenum metal. Conventional batch processes for producing molybdenum metal may be time consuming and relatively costly. Instead, it may be desirable to produce molybdenum metal on a continuous basis, particularly for industrial or commercial applications. For various applications it may also be desirable to produce molybdenum metal having a relatively uniform size and/or having a larger surface area to mass ratio than molybdenum metal that may be conventionally produced.

According to the teachings of the invention, novel forms of molybdenum metal 12 may be characterized as having a surface area to mass ratio of substantially 2.5 $m^2/g$ according to BET analysis. Also according to the teachings of the invention, novel forms of molybdenum metal 12 may be characterized as substantially uniform in size (see FIG. 5).

Novel forms of molybdenum metal characterized according to embodiments of the invention are advantageous in and of themselves for various uses or applications. For example, molybdenum metal that is characterized by a relatively high surface area to mass ratio is particularly advantageous when used as a catalyst. That is, less molybdenum metal is required on a mass basis when used as a catalyst to achieve similar or even better results than when molybdenum metal characterized by a smaller surface area to mass ratio is used as a catalyst in the same reactions. Also for example, molybdenum metal characterized by a relatively large surface area to mass ratio and/or a relatively uniform size may be advantageous for use as a sintering agent. That is, the molybdenum-sintering agent has a higher bonding area than conventional molybdenum sintering agents, thereby enhancing the resulting sinter. These novel forms of molybdenum metal may also be particularly advantageous for other uses or applications not specifically called out herein.

Also according to the teachings of the invention, embodiments of apparatus 10 for producing molybdenum metal 12 are disclosed. Apparatus 10 may comprise a furnace 16 having at least two, and preferably three heating zones 20, 21, and 22. A process tube 34 preferably extends through the furnace 16 so that a precursor material 14 (e.g., $MoO_3$) may be introduced into the process tube 34 and moved through the heating zones of the furnace 16, such as is illustrated by arrow 26 shown in FIG. 1. Also preferably, a process gas 62 may be introduced into the process tube 34, such as is illustrated by arrow 28 shown in FIG. 1. Accordingly, the precursor material 14 is reduced to form or produce molybdenum metal 12.

Apparatus 10 may be operated as follows for producing molybdenum metal 12 from a precursor material 14 (e.g., molybdic oxide ($MoO_3$)). As one step in the process, the precursor material is heated to a first temperature (e.g., in Heating Zone 1 of furnace 16) in the presence of a reducing gas 64. The first temperature is increased at least once (e.g., in Heating Zone 3, and also preferably in Heating Zone 2) to reduce the precursor material 14 and form the molybdenum metal 12.

Accordingly, molybdenum metal 12 may be produced in a continuous manner. Preferably, no intermediate handling is required during production of the molybdenum metal product 12. That is, the precursor material 14 is preferably fed into a product inlet end 15 of furnace 16, and the molybdenum metal product 12 is removed from a product discharge end 17 of furnace 16. Thus, for example, the intermediate product 30 (FIG. 2) need not be removed from one furnace or batch process and transferred to another furnace or batch process. As such, production of molybdenum metal 12 according to embodiments of the invention is less labor intensive and production costs may be lower than conventional processes for producing molybdenum metal. In addition, large-scale production plants may be more efficiently designed. For example, less equipment may be required for producing molybdenum metal 12 according to embodiments of the invention than may be required for conventional batch processes. Also for example, intermediate staging areas are not required according to embodiments of the invention.

Having generally described novel forms of molybdenum metal and apparatus and methods for production thereof, as well as some of the more significant features and advantages of the invention, the various embodiments of the invention will now be described in further detail.

Apparatus for Producing Molybdenum Metal

FIG. 1 is a schematic representation of an embodiment of apparatus 10 for producing molybdenum metal 12 according to embodiments of the invention. As an overview, the apparatus 10 may generally comprise a furnace 16, a transfer system 32, and a process gas 62, each of which will be explained in further detail below. The transfer system 32 may be used to introduce a precursor material 14 into the furnace 16 and move it through the furnace 16, for example, in the direction illustrated by arrow 26. In addition, the process gas 62 may be introduced into the furnace 16, for example, in the direction illustrated by arrow 28. Accordingly, the process gas 62 reacts with the precursor material 14 in the furnace 16 to form molybdenum metal product 12, as explained in more detail below with respect to embodiments of the method of the invention.

A preferred embodiment of apparatus 10 is shown in FIG. 1 and described with respect thereto. Apparatus 10 preferably comprises a rotating tube furnace 16. Accordingly, the transfer system 32 may comprise at least a process tube 34 extending through three heating zones 20, 21, and 22 of the furnace 16, and through a cooling zone 23. In addition, the transfer system 32 may also comprise a feed system 36 for feeding the precursor material 14 into the process tube 34, and a discharge hopper 38 at the far end of the process tube 34 for collecting the molybdenum metal product 12 that is produced in the process tube 34.

Before beginning a more detailed description of preferred embodiments of apparatus 10, however, it should be clear that other embodiments of the furnace 16 and the transfer system 32 are contemplated as being within the scope of the invention. The furnace may comprise any suitable furnace or design thereof, and is not limited to the rotating tube furnace 16, shown in FIG. 1 and described in more detail below. For example, according to other embodiments of the invention, the furnace 16 may also comprise, but is not limited to, more than one distinct furnace (e.g., instead of the single furnace 16 having separate heating zones 20, 21, 22 that are defined by refractory dams 46 and 47). Likewise, the transfer system 32, shown in FIG. 1 and described in more detail below, may comprise a variety of other means for introducing the precursor material 14 into the furnace 16, for moving the precursor material 14 through the furnace 16, and/or for collecting the molybdenum metal product 12 from the furnace 16. For example, in other embodiments the transfer system 32 may comprise manual introduction (not shown) of the precursor material 14 into the furnace 16, a conveyor belt (not shown) for moving the precursor material 14 through the furnace 16, and/or a mechanical collection arm (not shown) for removing the molybdenum metal product 12 from the furnace 16. Other embodiments of the furnace 16, and the transfer system 32, now known or later developed, are also contemplated as being within the scope of the invention, as will become readily apparent from the following detailed description of preferred embodiments of apparatus 10.

Turning now to a detailed description of preferred embodiments of apparatus 10, a feed system 36 may be operatively associated with the process tube 34. The feed system 36 may continuously introduce the precursor material 14 into the furnace 16. In addition, the feed system 36 may also introduce the precursor material 14 into the furnace 16 at a constant rate. For example, the feed system 36 may comprise a loss-in-weight feed system for continuously introducing the precursor material 14 into one end of the process tube 34 at a constant rate.

It is understood that according to other embodiments of the invention, the precursor material 14 may be otherwise introduced into the furnace 16. For example, the feed system 36 may feed the precursor material 14 into the furnace 16 on an intermittent basis or in batch. Other designs for the feed system 36 are also contemplated as being within the scope of the invention and may differ depending upon design considerations and process parameters, such as the desired rate of production of the molybdenum metal product 12.

In any event, the precursor material 14 is preferably introduced into the furnace 16 by feeding it into the process tube 34. The process tube 34 preferably extends through a chamber 44 that is formed within the furnace 16. The process tube 34 may be positioned within the chamber 44 so as to extend substantially through each of the heating zones 20, 21, and 22 of the furnace 16. Preferably, the process tube 34 extends in approximately equal portions through each of the heating zones 20, although this is not required. In addition, the process tube 34 may further extend beyond the heating zones 20, 21, and 22 of the furnace 16 and through a cooling zone 23.

According to preferred embodiments of the invention, the process tube 34 is a gas-tight, high temperature (HT) alloy process tube. The process tube 34 also preferably has a nominal external diameter of about 16.5 centimeters (cm) (about 6.5 inches (in)), a nominal internal diameter of about 15.2 cm (about 6 in), and is about 305 cm (about 120 in) long. Preferably, about 50.8 cm (about 20 in) segments of the process tube 34 each extend through each of the three heating zones 20, 21, and 22 of the furnace 16, and the remaining approximately 152.4 cm (60 in) of the process tube 34 extend through the cooling zone 23.

In other embodiments of the invention, however, the process tube 34 may be manufactured from any suitable material. In addition, the process tube 34 need not extend equally through each of the heating zones 20, 21, and 22 and/or the cooling zone 23. Likewise, the process tube 34 may be any suitable length and diameter. The precise design of the process tube 34 will depend instead on design considerations, such as the feed rate of the precursor material 14, the desired production rate of the molybdenum metal product 12, the temperature for each heating zone 20, 21, and 22, among other design considerations readily apparent to one skilled in the art based on the teachings of the invention.

The process tube 34 is preferably rotated within the chamber 44 of the furnace 16. For example, the transfer system 32 may comprise a suitable drive assembly operatively associated with the process tube 34. The drive assembly may be operated to rotate the process tube 34 in either a clockwise or counter-clockwise direction, as illustrated by arrow 42 in FIG. 1. Preferably, the process tube 34 is rotated at a constant rate. The rate is preferably selected from the range of approximately 18 to 100 seconds per revolution. For example, the process tube 34 may be rotated at a constant rate of 18 seconds per revolution. However, the process tube 34 may be rotated faster, slower and/or at variable rotational speeds, as required depending on design considerations, desired product size, and the set points of other process variables as would be apparent to persons having ordinary skill in the art after having become familiar with the teachings of the invention.

The rotation 42 of the process tube 34 may facilitate movement of the precursor material 14 and the intermediate material 30 (FIG. 2) through the heating zones 20, 21, and 22 of the furnace 16, and through the cooling zone 23. In addition, the rotation 42 of the process tube 34 may facilitate mixing of the precursor material 14 and the intermediate material 30. As such, the unreacted portion of the precursor material 14 and the intermediate material 30 is continuously exposed for contact with the process gas 62. Thus, the mixing may further enhance the reaction between the precursor material 14 and the intermediate material 30 and the process gas 62.

In addition, the process tube 34 is preferably positioned at an incline 40 within the chamber 44 of the furnace 16. One embodiment for inclining the process tube 34 is illustrated in FIG. 1. According to this embodiment of the invention, the process tube 34 may be assembled on a platform 55, and the platform 55 may be hinged to a base 56 so that the platform 55 may pivot about an axis 54. A lift assembly 58 may also engage the platform 55. The lift assembly 58 may be operated to raise or lower one end of the platform 55 with respect to the base 56. As the platform 55 is raised or lowered, the platform 55 rotates or pivots about the axis 54. Accordingly, the platform 55, and hence the process tube 34, may be adjusted to the desired incline 40 with respect to the grade 60.

Although preferred embodiments for adjusting the incline 40 of the process tube 34 are shown and described herein with respect to apparatus 10 in FIG. 1, it is understood that the process tube 34 may be adjusted to the desired incline 40 according to any suitable manner. For example, the process tube 34 may be fixed at the desired incline 40 and thus need not be adjustably inclined. As another example, the process tube 34 may be inclined independently of the furnace 16, and/or the other components of apparatus 10 (e.g., feed system 36). Other embodiments for inclining the process tube 34 are also contemplated as being within the scope of the invention, and will become readily apparent to one skilled in the art based upon an understanding of the invention.

In any event, the incline 40 of the process tube 34 may also facilitate movement of the precursor material 14 and intermediate material 30 through the heating zones 20, 21, and 22 of the furnace 16, and through the cooling zone 23. In addition, the incline 40 of the process tube 34 may facilitate mixing of the precursor material 14 and intermediate material 30 within the process tube 34, and expose the same for contact with the process gas 62 to enhance the reactions between the precursor material 14 and/or the intermediate material 30 and the process gas 62. Indeed, the combination of the rotation 42 and the incline 40 of the process tube 34 may further enhance the reactions for forming molybdenum metal product 12.

As previously discussed, the furnace 16 preferably comprises a chamber 44 formed therein. The chamber 44 defines a number of controlled temperature zones surrounding the process tube 34 within the furnace 16. In one embodiment, three temperature zones 20, 21, and 22 are defined by refractory dams 46 and 47. The refractory dams 46 and 47 are preferably closely spaced to the process tube 34 so as to discourage the formation of convection currents between the temperature zones. In one embodiment, for example, the refractory dams 46 and 47 come to within approximately 1.3 to 1.9 cm (0.5 to 0.75 in) from the process tube 34 to define three heating zones 20, 21, and 22 in the furnace 16. In any event, each of the three heating zones are preferably respectively maintained at the desired temperatures within the chamber 44 of the furnace 16. And hence, each segment of the process tube 34 is also maintained at the desired temperature, as shown in more detail in FIG. 2 discussed below.

Preferably, the chamber 44 of the furnace 16 defines the three heating zones 20, 21, and 22 shown and described herein with respect to FIG. 1. Accordingly, the precursor material 14 may be subjected to different reaction temperatures as it is moved through each of the heating zones 20, 21, and 22 in the process tube 34. That is, as the precursor material 14 is moved through the process tube 34 and into the first heating zone 20, the precursor material 14 is subjected to the temperature maintained within the first heating zone. Likewise, as the precursor material 14 is moved through the process tube 34 from the first heating zone 20 and into the second heating zone 21, it is subjected to the temperature maintained within the second heating zone.

It is understood that the heating zones 20, 21, and 22 may be defined in any suitable manner. For example, the heating zones 20, 21, and 22 may be defined by baffles (not shown), by a number of separate chambers (not shown), etc. Indeed, the heating zones 20, 21, and 22 need not necessarily be defined by refractory dams 46, 47, or the like. As an example, the process tube 34 may extend through separate, consecutive furnaces (not shown). As another example, the chamber 44 of the furnace 16 may be open and a temperature gradient may be generated within the chamber 44 to extend from one end of the chamber 44 to the opposite end of the chamber 44 using separate heating elements spaced along the length thereof.

It is also understood that more than three heating zones (not shown) may be defined within the furnace 16. According to yet other embodiments of the invention, fewer than three heating zones (also not shown) may be defined in the furnace 16. Still other embodiments will occur to those skilled in the art based on the teachings of the invention and are also contemplated as being within the scope of the invention.

The furnace 16 may be maintained at the desired temperatures using suitable temperature control means. In preferred embodiments, each of the heating zones 20, 21, and 22 of the furnace 16 are respectively maintained at the desired temperatures using suitable heat sources, temperature control, and over-temperature protection. For example, the heat source may comprise independently controlled heating elements 50, 51, and 52 positioned within each of the heating zones 20, 21, and 22 of the furnace 16, and linked to suitable control circuitry.

In one preferred embodiment, the temperature is regulated within the three heating zones 20, 21, and 22 of the furnace 16 by twenty-eight silicon-carbide, electrical-resistance heating elements. The heating elements are linked to three Honeywell UDC3000 Microprocessor Temperature Controllers (i.e., one controller for each of the three heating zones 20, 21, and 22) for setting and controlling the temperature thereof. In addition, three Honeywell UDC2000 Microprocessor Temperature Limiters (i.e., also one controller for each of the three heating zones 20, 21, and 22) are provided for over-temperature protection. It is understood, however, that any suitable temperature regulating means may be used to set and maintain the desired temperature within the furnace 16. For example, the heating elements need not necessarily be electronically controlled and may instead be manually controlled.

Although each of the heating zones are preferably maintained at relatively uniform temperatures, respectively, it is apparent that conduction and convection of heat may cause a temperature gradient to be established within one or more of the heating zones 20, 21, and 22. For example, although the refractory dams 46, 47 are spaced approximately 1.3 to 1.9 cm (0.5 to 0.75 in) from the process tube 34 to reduce or minimize the transfer or exchange of heat between the heating zones 20, 21, and 22, some heat exchange may still occur therebetween. Also for example, the process tube 34 and/or the precursor material and/or intermediate material may also conduct heat between the heating zones 20, 21, and 22. Therefore, the temperature measured at various points within each of the heating zones 20, 21, and 22 may be several degrees cooler or several degrees warmer (e.g., by about 50 to 100° C.) than the center of the heating zones 20, 21, and 22. Other designs are also contemplated to further reduce the occurrence of these temperature gradients, such as sealing the refractory dams 46, 47 about the process tube 34. In any event, the temperature settings for each of the heating zones 20, 21, and 22 are preferably measured in the center of each of the heating zones 20, 21, and 22 to more accurately maintain the desired temperature therein.

Preferably, the cooling zone (illustrated by outline 23 in FIG. 1) comprises a portion of the process tube 34 that is open to the atmosphere. Accordingly, the molybdenum metal product 12 is allowed to cool prior to being collected in the collection hopper 38. However, according to other embodiments of the invention, the cooling zone 23 may be one or more enclosed portions of apparatus 10. Likewise, suitable temperature regulating means may be used to set and maintain the desired temperature within the enclosed cooling zone 23. For example, a radiator may circulate fluid about the process tube 34 in cooling zone 23. Or for example, a fan or blower may circulate a cooling gas about the process tube 34 in cooling zone 23.

The process gas 62 is preferably introduced into the furnace 16 for reaction with the precursor material 14 and the intermediate product 30. According to preferred embodiments of the invention, the process gas 62 may comprise a reducing gas 64 and an inert carrier gas 65. The reducing gas 64 and the inert carrier gas 65 may be stored in separate gas cylinders near the far end of the process tube 34, as shown in FIG. 1. Individual gas lines, also shown in FIG. 1, may lead from the separate gas cylinders to a gas inlet 25 at the far end of the process tube 34. A suitable gas regulator (not shown) may be provided to introduce the reducing gas 64 and the inert carrier gas 65 from the respective gas cylinders into the process tube 34 in the desired proportions and at the desired rate.

According to embodiments of the invention, the reducing gas 64 may be hydrogen gas, and the inert carrier gas 65 may be nitrogen gas. However, it is understood that any suitable reducing gas 64, or mixture thereof, may be used according to the teachings of the invention. Likewise, the inert carrier gas 65 may be any suitable inert gas or mixture of gases. The composition of the process gas 62 will depend on design considerations, such as the cost and availability of the gases, safety issues, and desired rate of production, among other considerations.

Preferably, the process gas 62 is introduced into the process tube 34 and directed through the cooling zone 23 and through each of the heating zones 20, 21, and 22, in a direction opposite (i.e., counter-current, as illustrated by arrow 28) to the direction 26 that the precursor material 14 is moved through each of the heating zones 20, 21, and 22 of the furnace 16, and through the cooling zone 23. Directing the process gas 62 through the furnace 16 in a direction that is opposite or counter-current 28 to the direction 26 that the precursor material 14 is moving through the furnace 16 may increase the rate of the reaction of the precursor material 14 and the intermediate material 30 (FIG. 2) with the reducing gas 64. That is, the process gas 62 comprises higher concentrations of the reducing gas 64 when it is initially introduced to the process tube 34 and is thus likely to more readily react with the remaining or unreacted portion of the precursor material 14 and/or the intermediate material 30 at the far end of the process tube 34.

The unreacted process gas 62 that flows upstream toward the entry of the process tube 34 thus comprises a lower concentration of the reducing gas 64. However, presumably a larger surface area of unreacted precursor material 14 is available at or near the entry of the process tube 34. As such, smaller concentrations of reducing gas 64 may be required to react with the precursor material 14 at or near the entry of the process tube 34. In addition, introducing the process gas 62 in such a manner may enhance the efficiency with which the reducing gas 64 is consumed by the reaction therebetween, for reasons similar to those just explained.

It is understood that in other embodiments of the invention the process gas 62 may be introduced in any other suitable manner. For example, the process gas 62 may be introduced through multiple injection sites (not shown) along the length of the process tube 34. Or for example, the process gas 62 may be premixed and stored in its combined state in one or more gas cylinders for introduction into the furnace 16. These are merely exemplary embodiments, and still other embodiments are also contemplated as being within the scope of the invention.

The process gas 62 may also be used to maintain the internal or reaction portion of the process tube 34 at a substantially constant pressure, as is desired according to preferred embodiments of the invention. Indeed, according to one preferred embodiment of the invention, the process tube 34 is maintained at about 8.9 to 14 cm (about 3.5 to 5.5 in) of water pressure (gauge). The process tube 34 may be maintained at a constant pressure, according to one embodiment of the invention, by introducing the process gas 62 at a predetermined rate, or pressure, into the process tube 34, and discharging the unreacted process gas 62 at a predetermined rate, or pressure, therefrom to establish the desired equilibrium pressure within the process tube 34.

Preferably, the process gas 62 (i.e., the inert carrier gas 65 and the unreacted reducing gas 64) is discharged from the process tube 34 through a scrubber 66 at or near the entry of the process tube 34 to maintain the process tube 34 at a substantially constant pressure. The scrubber 66 may comprise a dry pot 67, a wet pot 68, and a flare 69. The dry pot 67 is preferably provided upstream of the wet pot 68 for collecting any dry material that may be discharged from the process tube 34 to minimize contamination of the wet pot 68. The process gas 62 is discharged through the dry pot 67 and into water contained in the wet pot 68. The depth of the water that the process gas 62 is discharged into within the wet pot 68 controls the pressure of the process tube 34. Any excess gas may be burned at the flare 69.

Other embodiments for maintaining the process tube 34 at a substantially constant pressure are also contemplated as being within the scope of the invention. For example, a discharge aperture (not shown) may be formed within a wall 74 (FIG. 2) of the process tube 34 for discharging the unreacted process gas 62 from the process tube 34 to maintain the desired pressure therein. Or for example, one or more valves (not shown) may be fitted into a wall 74 (FIG. 2) of the process tube 34 for adjustably releasing or discharging the unreacted process gas 62 therefrom. Yet other embodiments for maintaining the pressure within the process tube 34 are also contemplated as being within the scope of the invention.

The various components of apparatus 10, such as are shown in FIG. 1 and described in the immediately preceding discussion, are commercially available. For example, a Harper Rotating Tube Furnace (Model No. HOU-6D60-RTA-28-F), is commercially available from Harper International Corporation (Lancaster, N.Y.), and may be used according to the teachings of the invention, at least in part, to produce molybdenum metal product 12.

The Harper Rotating Tube Furnace features a high-heat chamber with a maximum temperature rating of 1450° C. A number of refractory dams divide the high-heat chamber into three independent temperature control zones. The three temperature control zones feature discrete temperature control using twenty-eight silicon-carbide electrical resistance heating elements. Thermocouplers are provided at the center of each control zone along the centerline of the roof of the furnace. The temperature control zones are regulated by three Honeywell UDC3000 Microprocessor Temperature Controllers, and by three Honeywell UDC2000 Microprocessor Temperature Limiters, each commercially available from Honeywell International, Inc. (Morristown, N.J.).

The Harper Rotating Tube Furnace also features a gas-tight, high temperature alloy process tube, having a maximum rating of 1100° C. The process tube has a nominal internal diameter of 15.2 cm (6.0 in), nominal external ends diameter of 16.5 cm (6.5 in), and an overall length of 305 cm (120 in). The process tube extends in equal segments (each having a length of 50.8 cm (20 in)) through each of the temperature control zones, leaving 152 cm (60 in) extending through the cooling zone.

The process tube provided with the Harper Rotating Tube Furnace may be inclined within a range of 0 to 5°. In addition, the Harper Rotating Tube Furnace may be provided with a variable direct current (DC) drive with digital speed control for rotating the process tube at rotational speeds of one to five revolutions per minute (rpm).

The Harper Rotating Tube Furnace also features a 316-liter, stainless steel, gas-tight with inert gas purge, discharge hopper. The Harper Rotating Tube Furnace also features an atmosphere process gas control system for maintaining a constant pressure within the process tube. In addition, a 45-kilowatt (kW) power supply may be provided, for heating the furnace and driving the process tube. In addition, the Harper Rotating Tube Furnace may be fitted with a Brabender Loss-In-Weight Feed System (Model No. H31-FW33/50), commercially available from C.W. Brabender Instruments, Inc. (South Hackensack, N.J.).

Although preferred embodiments of apparatus 10 are shown in FIG. 1 and have been described above, it is understood that other embodiments of apparatus 10 are also contemplated as being within the scope of the invention. In addition, it is understood that apparatus 10 may comprise any suitable components from various manufacturers, and are not limited to those provided herein. Indeed, where apparatus 10 is designed for large or industrial-scale production, the various components may be specifically manufactured therefor, and the specifications will depend on various design considerations, such as but not limited to, the scale thereof.

Method for Producing Molybdenum Metal

Having described apparatus 10, and preferred embodiments thereof, that may be used to produce molybdenum metal product 12 according to the invention, attention is now directed to embodiments of a method for producing molybdenum metal product 12. As an overview, and still with reference to FIG. 1, the precursor material 14 is preferably introduced into the furnace 16 and moved through the heating zones 20, 21, and 22, and the cooling zone 23 thereof. The process gas 62 is preferably introduced into the furnace 16 for reaction with the precursor material 14 and the intermediate material 30. The precursor material 14 and the intermediate material 30 react with the process gas 62 therein to produce molybdenum metal product 12, as discussed in more detail below with respect to preferred embodiments of the method.

According to preferred embodiments, the precursor material 14 comprises nano-particles of molybdic oxide ($MoO_3$).

The nano-particles of molybdic oxide preferably have a typical surface area to mass ratio of about 25 to 35 $m^2g$. When these nano-particles of molybdic oxide are used as the precursor material 14, the molybdenum metal product 12 produced according to embodiments of the method of the invention may be characterized as having a surface area to mass ratio of about 2.5 $m^2/g$. In addition, the molybdenum metal product 12 may be characterized as being uniform in size.

The nano-particles of molybdic oxide described above may be produced according to embodiments of the invention disclosed in co-owned, U.S. Pat. No. 6,468,497 issued on Oct. 22, 2002 for "METHOD FOR PRODUCING NANO-PARTICLES OF MOLYBDENUM OXIDE" of Khan, et al., which is incorporated herein for all that it discloses. The nano-particles of molybdic oxide are produced by, and are commercially available from the Climax Molybdenum Company (Fort Madison, Iowa).

According to other embodiments of the invention, however, it is understood that the precursor material 14 may comprise any suitable grade or form of molybdic oxide ($MoO_3$). For example, the precursor material 14 may range in size from 0.5 to 80 $m^2/g$. Selection of the precursor material 14 may depend on various design considerations, including but not limited to, the desired characteristics of the molybdenum metal product 12 (e.g., surface area to mass ratio, size, purity, etc.). In general, the surface area to mass ratio of the molybdenum metal product 12 is proportionate to the surface area to mass ratio of the precursor material 14, and typically ranges from 1.5 to 4.5 $m^2/g$.

Figure 2:
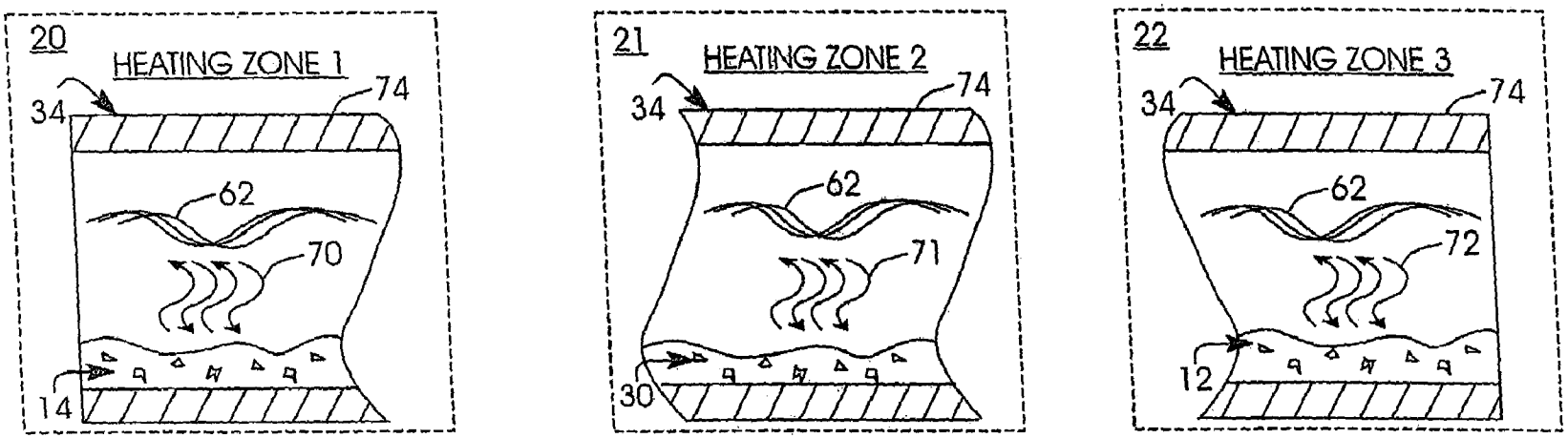
FIG. 2 is a cross-sectional view of three sections of a process tube illustrating molybdenum metal production.

Turning now to FIG. 2, the process tube 34 (walls 74 thereof are shown) is illustrated in three cross-sectional portions of the process tube 34. Each cross-sectional portion shown in FIG. 2 is taken respectively from each of the three heating zones 20, 21, and 22 of the furnace 16. According to preferred embodiments of the method, the precursor material 14 is introduced into the process tube 34, and moves through the each of the three heating zones 20, 21, and 22 of the furnace 16 (i.e., Heating Zone 1, Heating Zone 2, and Heating Zone 3, in FIG. 2). The process tube 34 may be rotating and/or inclined to facilitate movement and mixing of the precursor material 14 therein, as described in more detail above with respect to embodiments of apparatus 10. In addition, the process gas 62 is also introduced into the process tube 34. Preferably, the process gas 62 flows through the process tube 34 in a direction 28 that is opposite or counter-current to the direction 26 that the precursor material 14 is moving through the process tube 34, such as may be accomplished according to the embodiments of apparatus 10 discussed in more detail above.

As the precursor material 14 moves through the first heating zone 20, it is mixed with the process gas 62 and reacts therewith to form the intermediate product 30. The reaction is illustrated by arrows 70 in heating zone 20 (Heating Zone 1) of FIG. 2. More particularly, the reaction in the first heating zone 20 (Heating Zone 1) may be described as solid molybdic oxide ($MoO_3$) being reduced by the reducing gas 64 (e.g., hydrogen gas) in the process gas 62 to form solid moly-dioxide ($MoO_2$) (i.e., intermediate product 30 in FIG. 2) and, for example, water vapor when the reducing gas 64 is hydrogen gas. The reaction between the precursor material 14 and the reducing gas 64 may be expressed by the following chemical formula:

$$MoO_3(s)+H_2(g)\rightarrow MoO_2(s)+H_2O(v)$$

The temperature in the first heating zone 20 is preferably maintained below the vaporization temperature of the precursor material 14, and that of any intermediate material 30 that is formed in the first heating zone 20 (Heating Zone 1), relative to the pressure within the process tube 34. Overheating the precursor material 14 and/or the intermediate material 30 may cause a reaction only on the surface thereof. The resulting surface reaction may cause beads of molybdenum metal to form, sealing unreacted precursor material 14 and/or intermediate material 30 therein. These beads may require longer processing times and/or higher processing temperatures to convert to pure molybdenum metal product 12, thus reducing the efficiency and increasing the cost of production.

The temperature of the first heating zone 20 is preferably maintained at a lower temperature than the other two heating zones 21, and 22 because the reaction between the precursor material 14 and the reducing gas 64 in the first heating zone 20 (Heating Zone 1) is an exothermic reaction. That is, heat is released during the reaction in the first heating zone 20.

The second heating zone 21 (Heating Zone 2) is preferably provided as a transition zone between the first heating zone 20 (Heating Zone 1) and the third heating zone 22 (Heating Zone 3). That is, the temperature in the second heating zone 21 is maintained at a higher temperature than the first heating zone 20, but preferably maintained at a lower temperature than the third heating zone 22. As such, the temperature of the intermediate material 30 and the unreacted precursor material 14 is gradually ramped up for introduction into the third heating zone 22. Without the second heating zone 22, an immediate transfer of the intermediate material 30 and the unreacted precursor material 14 from the lower temperatures of the first heating zone 20 (Heating Zone 1) to the higher temperatures of the third heating zone 22 (Heating Zone 3) may cause beads of unreacted material to form. The disadvantages of these beads are discussed above. In addition, the molybdenum metal product 12 may agglomerate and produce undesirable product "chunks".

As the intermediate material 30 moves into the third heating zone 22 (Heating Zone 3), it continues to be mixed with the process gas 62 and reacts therewith to form the molybdenum metal product 12, as illustrated by arrows 72 in FIG. 2. More particularly, the reaction in the third heating zone 22 (Heating Zone 3) may be described as solid moly-dioxide ($MoO_2$) being reduced by the reducing gas 64 (e.g., hydrogen gas) in the process gas 62 to form solid molybdenum metal product 12 (Mo) and, for example, water vapor when the reducing gas 64 is hydrogen gas. The reaction between the intermediate material 30 and the process gas 62 may be expressed by the following chemical formula:

$$MoO_2(s)+2H_2(g)\rightarrow Mo(s)+2H_2O(v)$$

The reaction between the intermediate material 30 and the reducing gas 64 in the third heating zone 22 (Heating Zone 3) is an endothermic reaction. That is, heat is consumed during this reaction. Therefore, the energy input of the third heating zone 22 is preferably adjusted accordingly to provide the additional heat required by the endothermic reaction in the third heating zone 22.

When the molybdenum metal 12 produced by the reactions described above is immediately introduced to an atmospheric environment while still hot (e.g., upon exiting the third heating zone 22), it may react with one or more constituents of the atmosphere. For example, the hot molybdenum metal 12 may reoxidize when it is exposed to an oxygen environment. Therefore, the molybdenum metal product 12 is preferably moved through a cooling zone 23. Also preferably, the process gas 62 flows through the cooling zone so that the hot molybdenum metal product 12 may be cooled in a reducing environment, thus lessening or eliminating the occurrence of reoxidation of the molybdenum metal product 12 (e.g., to form $MoO_2$ and/or $MoO_3$). The cooling zone 23 may also be provided to cool the molybdenum metal product 12 for handling purposes.

As explained above, the reactions in the first heating zone 20 (Heating Zone 1) are primarily the precursor material 14 being reduced to form intermediate material 30. Also as explained above, the second heating zone 21 (Heating Zone 2) is primarily provided as a transition zone for the intermediate material 30 produced in the first heating zone 20 before it is introduced to the third heating zone 22 (Heating Zone 3). And also as explained above, the reactions in the third heating zone 22 are primarily the intermediate material 30 being further reduced to form the molybdenum metal product 12. However, the preceding discussion of the reactions in each of the heating zones 20, 21, and 22 shown in FIG. 2 are merely illustrative of the process of the invention.

As will be readily apparent to one skilled in the art, it is understood that these reactions may occur in each of the three heating zones 20, 21, and 22, as illustrated by arrows 70, 71, and 72. That is, some molybdenum metal product 12 may be formed in the first heating zone 20 and/or the second heating zone 21. Likewise, some unreacted precursor material 16 may be introduced into the second heating zone 21 and/or the third heating zone 22. In addition, some reactions may still occur even in the cooling zone 23.

Also as will be readily apparent to one skilled in the art, any unreacted reducing gas 64 and the inert gas 65 is also discharged in the effluent. Likewise, where a reducing gas 64 other than hydrogen is used, the reducing agent combined with oxygen stripped from the molybdic oxide, is also released in the effluent.

Having discussed the reactions in the various portions of the furnace 16 illustrated in FIG. 2, it should be noted that optimum conversion of the precursor material 14 to the molybdenum metal product 12 were observed to occur when the process parameters were set to values in the ranges shown in Table 1.

TABLE 1

| PARAMETER | SETTING |
|---|---|
| Process Tube Incline | 0.5° to 1.2° |
| Process Tube Rotation Rate | 18 to 100 seconds per revolution |
| Temperature | |
| Zone 1 | 540° C. to 600° C. |
| Zone 2 | 760° C. to 820° C. |
| Zone 3 | 980° C. to 1050° C. |
| Process Gas Flow Rate | 60 to 120 cubic feet per hour |

It is understood that molybdenum metal product 12 may also be produced when the process parameters are adjusted outside of the ranges given above in Table 1, as may be readily determined by one skilled in the art based on the teachings of the invention.

According to preferred embodiments of the invention, it is not necessary to screen the molybdenum metal product 12 to remove precursor material 14, intermediate material 30, and/or other contaminating material (not shown) from the product. That is, preferably, 100% of the precursor material 14 is fully converted to pure molybdenum metal product 12. However, according to embodiments of the invention, the molybdenum metal product 12 may be screened to remove oversize particles from the product that may have agglomerated during the process. Whether the molybdenum metal product 12 is screened will depend on design considerations such as, but not limited to, the ultimate use for the molybdenum metal product 12, the purity and/or particle size of the precursor material 14, etc.

Figure 3:
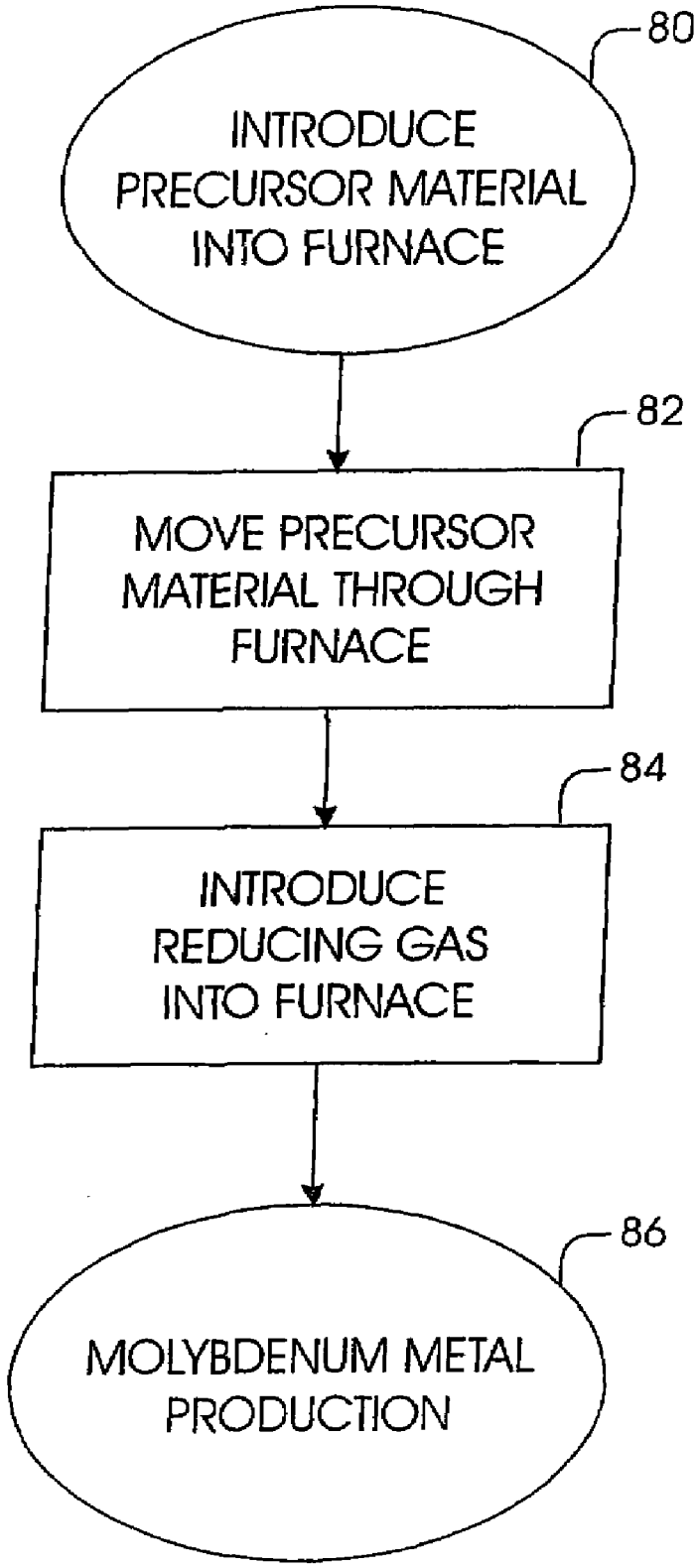
FIG. 3 is a flow chart illustrating an embodiment of a method for producing molybdenum metal according to the invention.

An embodiment of a method for producing molybdenum metal 12 according to the teachings of the invention is illustrated as steps in the flow chart shown in FIG. 3. In step 80, the precursor material 14 may be introduced into the furnace 16. As discussed above, the precursor material 14 is preferably introduced into the furnace 16 by feeding it into a process tube 34 extending through the furnace 16. In step 82, the precursor material 14 is moved through the furnace 16. As discussed above, the precursor material 14 is preferably moved (e.g., within the process tube 34) through three heating zones 20, 21, and 22, and through a cooling zone 23 of the furnace 16. In step 84, the reducing gas 64 may be introduced into the furnace 16. Again, as discussed above, the reducing gas 64 is preferably introduced into the process tube 34 and preferably flows therethrough in a direction 28 that is opposite or counter-current to the direction 26 that the precursor material 14 is moving through the furnace 16. Accordingly, the precursor material 14 is reduced and molybdenum metal 12 is produced, as illustrated by step 86 and described in more detail above with respect to FIG. 2.

It is understood that the steps shown and described with respect to FIG. 3 are merely illustrative of an embodiment of the method for producing molybdenum metal 12. Other embodiments of the method are also contemplated as being within the scope of the invention. Another embodiment of the method may also comprise the steps of inclining the process tube 34 for feeding the precursor material 14 into the furnace 16. Likewise another embodiment of the method may also comprise rotating 42 the precursor material 14 to facilitate movement of the same through the process tube 34 and to enhance the reaction thereof, as described above in more detail with respect to apparatus 10. Yet another embodiment of the method may comprise the step of maintaining the furnace 16 at a constant pressure. For example, such an embodiment of the method may comprise the step of discharging the process gas 62 from the furnace 16 through a scrubber 68 to maintain the furnace 16 at a constant pressure.

Still other embodiments are also contemplated as being within the scope of the invention. Indeed, it is expected that yet other embodiments of the method for producing molybdenum metal product will become readily apparent to one skilled in the art based on the teachings of the invention.

Characteristics of Molybdenum Metal

Having described methods and apparatus 10 for producing molybdenum metal according to the invention, characteristics of molybdenum metal will now be shown and described in further detail.

Prior Art

Figure 4:
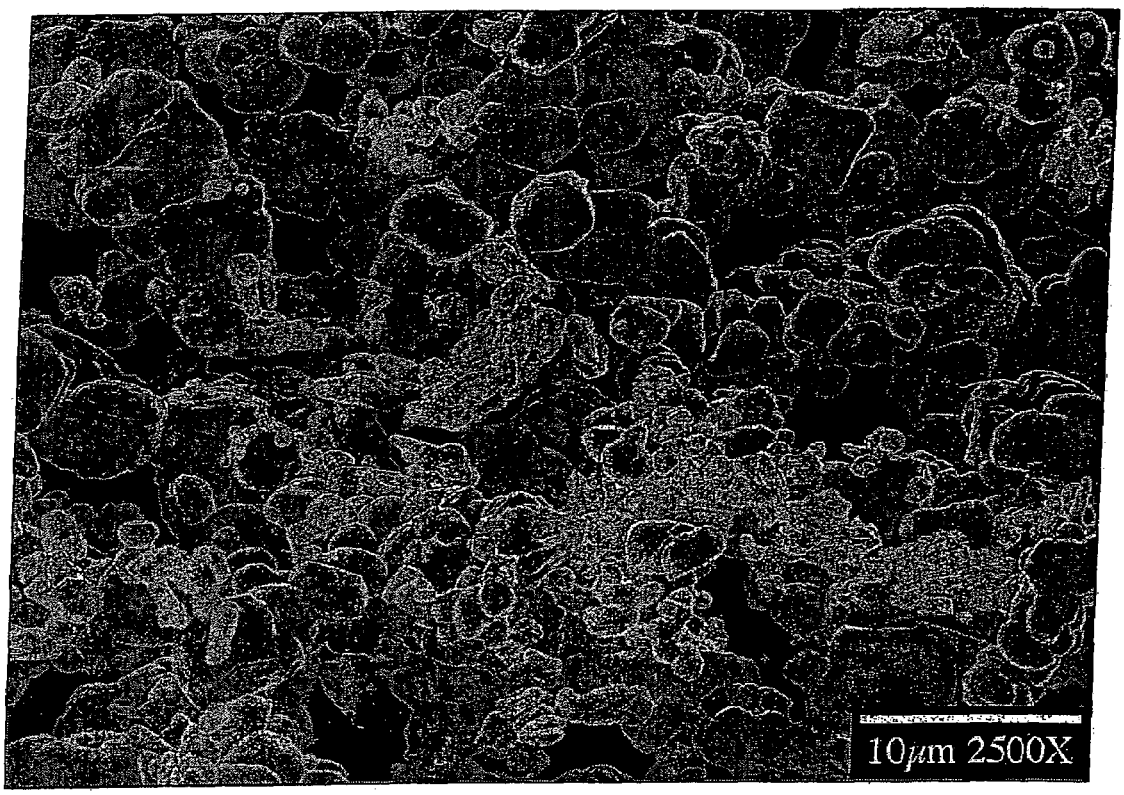
FIG. 4 PRIOR ART
FIG. 4 is a scanning electron microscope image of molybdenum metal, such as may be produced according to prior art processes.

FIG. 4 shows molybdenum metal that may be produced according to prior art processes. FIG. 4 is an image produced using a scanning electron microscope (SEM) in a process that is commonly referred to as scanning electron microscopy. As is readily seen in FIG. 4, the individual particles of molybdenum metal vary widely in size and shape from one another. While the size of the molybdenum metal can be expressed in terms of the mean length or the mean diameter of the particles (e.g., as detected by scanning electron microscopy), it is generally more useful to express the size of molybdenum metal in terms of surface area per unit mass due to the correlation between size and surface area.

Measurements of particle surface area per unit weight may be obtained by BET analysis. As is well known, BET analysis involves an extension of the Langmuir isotherm equation using multi-molecular layer absorption developed by Brunauer, Emmett, and Teller (hence, BET). BET analysis is an established analytical technique that provides highly accurate and definitive results.

The molybdenum metal, as shown in FIG. 4 and produced according to prior art processes, may be characterized by a surface area of about 0.8 square meters/gram ($m^2/g$), as measured in accordance with the BET analysis technique. Alternately, other types of measuring processes may be used to determine particle characteristics.

Novel Forms of Molybdenum Metal Product

Figure 5:
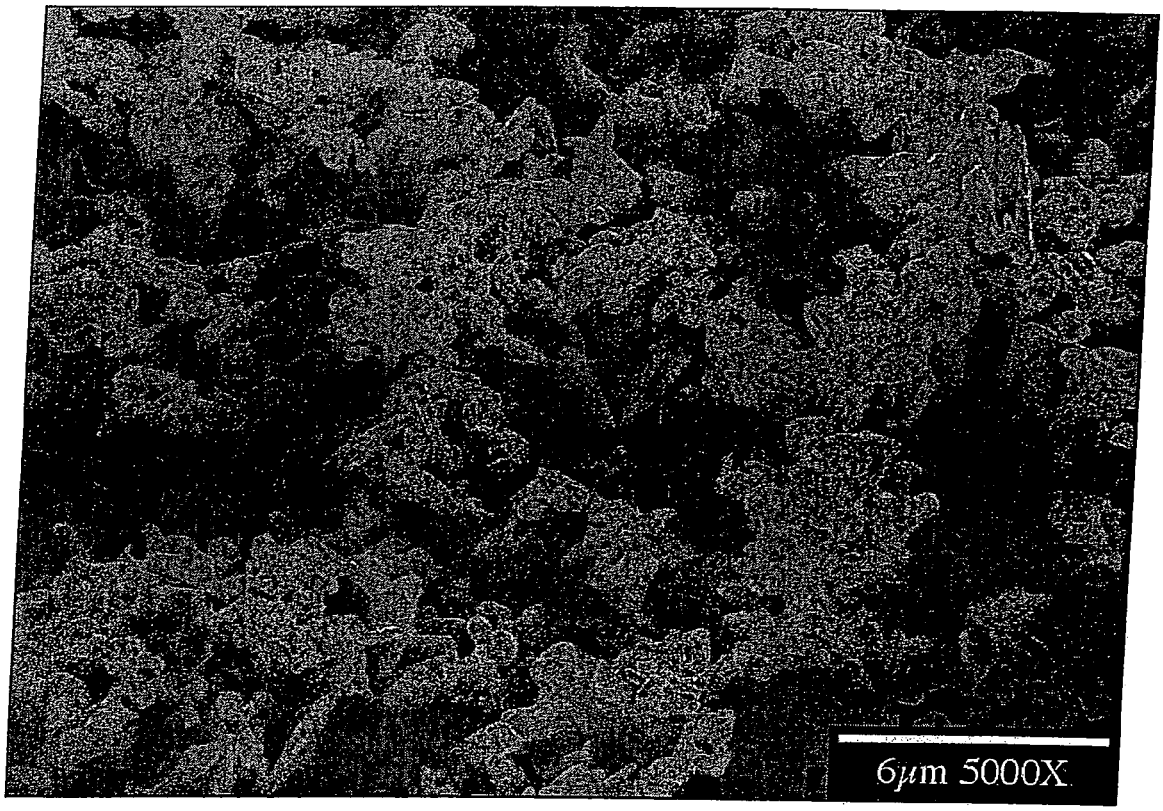
FIG. 5 is a scanning electron microscope image of novel forms of molybdenum metal such as may be produced according to one embodiment of the invention.

FIG. 5 is a scanning electron microscope image of molybdenum metal product 12 produced according to an embodiment of the invention. As can be readily seen in FIG. 5, the individual particles of molybdenum metal 12 comprise a generally elongated or cylindrical configuration having a mean length that is greater than its mean diameter. In addition, the molybdenum metal product 12 is substantially uniform in size and shape. For example, 50% of the non-screened molybdenum metal product 12 shown in FIG. 5 has a mean size of less than 24.8 micrometers (μm), and 99% of the non-screened molybdenum metal product 12 shown in FIG. 5 has a mean size of less than 194 μm. After grinding to break up agglomerations of the product, the non-screened molybdenum metal product 12 has an overall mean size of 1.302 μm, with 50% of the non-screened molybdenum metal product 12 having a mean size of less than 1.214 μm, and 99% of the non-screened molybdenum metal product 12 having a mean size of less than 4.656 μm.

Again, although the size of the molybdenum metal product 12 can be expressed in terms of the mean length or the mean diameter of the particles (e.g., as detected by scanning electron microscopy), it is generally more useful to express the size of molybdenum metal in terms of surface area per unit mass due to the correlation between size and surface area.

The molybdenum metal product 12 shown and described with respect to FIG. 5 was produced according to an embodiment of the method and apparatus of the invention. The molybdenum metal product 12 is characterized by a surface area of about 2.5 $m^2/g$, as measured in accordance with the BET analysis technique. Again, other types of measuring processes may be used to determine particle characteristics.

EXAMPLE 1

In this Example 1, the precursor material comprised nano-particles of molybdic oxide ($MoO_3$) having a typical size of about 25 to 35 $m^2/g$. Such nano-particles of molybdic oxide may be produced according to embodiments of the invention disclosed in co-owned, U.S. Pat. No. 6,468,497 issued on Oct. 22, 2002 for "METHOD FOR PRODUCING NANO-PARTICLES OF MOLYBDENUM OXIDE". The nano-particles of molybdic oxide used as precursor material in this example are produced by and are commercially available from the Climax Molybdenum Company (Fort Madison, Iowa).

The following equipment was used for this example: a Brabender Loss-In-Weight Feed System (Model No. H31-FW33/50), commercially available from C.W. Brabender Instruments, Inc. (South Hackensack, N.J.); and a Harper Rotating Tube Furnace (Model No. HOU-6D60-RTA-28-F), commercially available from Harper International Corporation (Lancaster, N.Y.). The Harper Rotating Tube Furnace comprised three independently controlled 50.8 cm (20 in) long heating zones with a 305 cm (120 in) HT alloy tube extending through each of the heating zones thereof. Accordingly, a total of 152 cm (60 in) of heating and 152 cm (60 in) of cooling were provided in this example.

In this example, the precursor material was fed, using the Brabender Loss-In-Weight Feed System, into the HT alloy tube of the Harper Rotating Tube Furnace. The HT alloy tube was rotated and inclined (see Table 2, below) to facilitate movement of the precursor material through the Harper Rotating Tube Furnace, and to facilitate mixing of the precursor material with a process gas. The process gas was introduced through the HT alloy tube in a direction opposite or counter-current to the direction that the precursor material was moving through the HT alloy tube. In this example, the process gas comprised hydrogen gas as the reducing gas, and nitrogen gas as the inert carrier gas. The discharge gas was bubbled through a water scrubber to maintain the interior of the furnace at approximately 11.4 cm (4.5 in) of water pressure (gauge).

Optimum conversion of the precursor material to the molybdenum metal product occurred when the parameters were set to the values shown in Table 2.

TABLE 2

| PARAMETER | SETTING |
|---|---|
| Precursor Feed Rate | 5 to 7 grams per minute |
| Process Tube Incline | 1° |
| Process Tube Rotation | 20 seconds per revolution |
| Temperature Set Points | |
| Zone 1 | 555° C. |
| Zone 2 | 800° C. |
| Zone 3 | 1000° C. |
| Process Gas Rate | 80 cubic feet per hour |

Molybdenum metal 12 produced according to this example is shown in FIG. 5, and discussed above with respect thereto. Specifically, the molybdenum metal product 12 produced according to this example is characterized by a surface area to mass ratio of 2.5 $m^2/g$. The molybdenum metal product 12 produced according to this example is also characterized by a uniform size. That is, 50% of the non-screened molybdenum metal product 12 shown in FIG. 5 had a mean size of less than 24.8 μm, and 99% of the non-screened molybdenum metal product 12 shown in FIG. 5 had a mean size of less than 194 μm.

EXAMPLE 2

In this Example 2, the precursor material comprised nano-particles of molybdic oxide ($MoO_3$) having a typical size of about 30–50 $m^2/g$. Such nano-particles of molybdic oxide may be produced according to embodiments of the invention disclosed in co-owned, U.S. Pat. No. 6,468,497 issued on Oct. 22, 2002 for "METHOD FOR PRODUCING NANO-PARTICLES OF MOLYBDENUM OXIDE". The nano-particles of molybdic oxide used as precursor material in this example are produced by and are commercially available from the Climax Molybdenum Company (Fort Madison, Iowa).

The following equipment was used for this example: a Brabender Loss-In-Weight Feed System (Model No. H31-FW33/50), commercially available from C.W. Brabender Instruments, Inc. (South Hackensack, N.J.); and a Harper Rotating Tube Furnace (Model No. HOU-6D60-RTA-28-F), commercially available from Harper International Corporation (Lancaster, N.Y.). The Harper Rotating Tube Furnace comprised three independently controlled 50.8 cm (20 in) long heating zones with a 305 cm (120 in) HT alloy tube extending through each of the heating zones thereof. Accordingly, a total of 152 cm (60 in) of heating and 152 cm (60 in) of cooling were provided in this example.

In this example, the precursor material was fed, using the Brabender Loss-In-Weight Feed System, into the HT alloy tube of the Harper Rotating Tube Furnace. The HT alloy tube was rotated at 20 seconds per revolution and inclined to 0.3° (see Table 3, below) to facilitate movement of the precursor material through the Harper Rotating Tube Furnace, and to facilitate mixing of the precursor material with a process gas. However, satisfactory results can be obtained with other tube inclinations (e.g., in a range of about 0.2° to about 0.4°). The process gas was introduced through the HT alloy tube in a direction opposite or counter-current to the direction that the precursor material was moving through the HT alloy tube. In this example, the process gas comprised hydrogen gas as the reducing gas, and nitrogen gas as the inert carrier gas. The discharge gas was bubbled through a water scrubber to maintain the interior of the furnace at approximately 11.4 cm (4.5 in) of water pressure (gauge).

Optimum conversion of the precursor material to the molybdenum metal product occurred when the parameters were set to the values shown in Table 3.

TABLE 3

| PARAMETER | SETTING |
|---|---|
| Precursor Feed Rate | 9.0 grams per minute |
| Process Tube Incline | 0.3° |
| Process Tube Rotation Rate | 20 seconds per revolution |
| Temperature | |
| Zone 1 | 600° C. |
| Zone 2 | 800° C. |
| Zone 3 | 1000° C. |
| Process Gas Flow Rate | 80 cubic feet per hour |
| Surface Area, BET, $m^2/g$ | 2.0837 |
| Horiba Data | |
| Horiba mean, microns | 1.598 |
| D10, microns | 0.858 |
| D50, microns | |
| D90, microns | 2.598 |

The molybdenum metal product 12 produced according to this Example 2 is characterized by a surface area to mass ratio of 2.0837 $m^2/g$ (BET). After grinding to break up agglomerations of the product 12, the non-screened molybdenum product 12 had an overall mean size of 1.598 μm, as measured by a Horiba laser scattering analyzer.

EXAMPLE 3

In this Example 3, the precursor material comprised nano-particles of molybdic oxide ($MoO_3$) having a typical size of about 30–50 $m^2/g$. Such nano-particles of molybdic oxide may be produced according to embodiments of the invention disclosed in co-owned, U.S. Pat. No. 6,468,497 issued on Oct. 22, 2002 for "METHOD FOR PRODUCING NANO-PARTICLES OF MOLYBDENUM OXIDE". The nano-particles of molybdic oxide used as precursor material in this example are produced by and are commercially available from the Climax Molybdenum Company (Fort Madison, Iowa).

The following equipment was used for this example: a Brabender Loss-In-Weight Feed System (Model No. H31-FW33/50), commercially available from C.W. Brabender Instruments, Inc. (South Hackensack, N.J.); and a Harper Rotating Tube Furnace (Model No. HOU-6D60-RTA-28-F), commercially available from Harper International Corporation (Lancaster, N.Y.). The Harper Rotating Tube Furnace comprised three independently controlled 50.8 cm (20 in) long heating zones with a 305 cm (120 in) HT alloy tube extending through each of the heating zones thereof. Accordingly, a total of 152 cm (60 in) of heating and 152 cm (60 in) of cooling were provided in this example.

In this example, the precursor material was fed, using the Brabender Loss-In-Weight Feed System, into the HT alloy tube of the Harper Rotating Tube Furnace. The HT alloy tube was rotated at 20 seconds per revolution and inclined to 0.3° (see Table 4, below) to facilitate movement of the precursor material through the Harper Rotating Tube Furnace, and to facilitate mixing of the precursor material with a process gas. However, satisfactory results can be obtained with other tube inclinations (e.g., in a range of about 0.2° to about 0.4°). The process gas was introduced through the HT alloy tube in a direction opposite or counter-current to the direction that the precursor material was moving through the HT alloy tube. In this example, the process gas comprised hydrogen gas as the reducing gas, and nitrogen gas as the inert carrier gas. The discharge gas was bubbled through a water scrubber to maintain the interior of the furnace at approximately 11.4 cm (4.5 in) of water pressure (gauge).

Optimum conversion of the precursor material to the molybdenum metal product occurred when the parameters were set to the values shown in Table 4.

TABLE 4

| PARAMETER | SETTING |
|---|---|
| Precursor Feed Rate | 9.0 grams per minute |
| Process Tube Incline | 0.3° |
| Process Tube Rotation Rate | 20 seconds per revolution |
| Temperature | |
| Zone 1 | 600° C. |
| Zone 2 | 790° C. |
| Zone 3 | 900° C. |
| Process Gas Flow Rate | 80 cubic feet per hour |
| Surface Area, BET, $m^2/g$ | 3.412 |
| Horiba Data | |
| Horiba mean, microns | 1.019 |
| D10, microns | 0.681 |
| D50, microns | |
| D90, microns | 1.422 |

The molybdenum metal product 12 produced according to this example is characterized by a surface area to mass ratio of 3.412 $m^2/g$ (BET). After grinding to break up agglomerations of the product 12, the non-screened molybdenum metal product 12 had an overall mean size of 1.019 μm, as measured by a Horiba laser scattering analyzer.

EXAMPLE 4

In this Example 4, the precursor material comprised nano-particles of molybdic oxide ($MoO_3$) having a typical size of about 30–50 $m^2/g$. Such nano-particles of molybdic oxide may be produced according to embodiments of the invention disclosed in co-owned, U.S. Pat. No. 6,468,497 issued on Oct. 22, 2002 for "METHOD FOR PRODUCING NANO-PARTICLES OF MOLYBDENUM OXIDE". The nano-particles of molybdic oxide used as precursor material in this example are produced by and are commercially available from the Climax Molybdenum Company (Fort Madison, Iowa).

The following equipment was used for this example: a Brabender Loss-In-Weight Feed System (Model No. H31-FW33/50), commercially available from C.W. Brabender Instruments, Inc. (South Hackensack, N.J.); and a Harper Rotating Tube Furnace (Model No. HOU-6D60-RTA-28-F), commercially available from Harper International Corporation (Lancaster, N.Y.). The Harper Rotating Tube Furnace comprised three independently controlled 50.8 cm (20 in) long heating zones with a 305 cm (120 in) HT alloy tube extending through each of the heating zones thereof. Accordingly, a total of 152 cm (60 in) of heating and 152 cm (60 in) of cooling were provided in this example.

In this example, the precursor material was fed, using the Brabender Loss-In-Weight Feed System, into the HT alloy tube of the Harper Rotating Tube Furnace. The HT alloy tube was rotated at 20 seconds per revolution and inclined to 0.3° (see Table 5, below) to facilitate movement of the precursor material through the Harper Rotating Tube Furnace, and to facilitate mixing of the precursor material with a process gas. However, satisfactory results can be obtained with other tube inclinations (e.g., in a range of about 0.2° to about 0.4°). The process gas was introduced through the HT alloy tube in a direction opposite or counter-current to the direction that the precursor material was moving through the HT alloy tube. In this example, the process gas comprised hydrogen gas as the reducing gas, and nitrogen gas as the inert carrier gas. The discharge gas was bubbled through a water scrubber to maintain the interior of the furnace at approximately 11.4 cm (4.5 in) of water pressure (gauge).

Optimum conversion of the precursor material to the molybdenum metal product occurred when the parameters were set to the values shown in Table 5.

TABLE 5

| PARAMETER | SETTING |
|---|---|
| Precursor Feed Rate | 5.0 grams per minute |
| Process Tube Incline | 0.3° |
| Process Tube Rotation Rate | 20 seconds per revolution |
| Temperature | |
| Zone 1 | 600° C. |
| Zone 2 | 750° C. |
| Zone 3 | 850° C. |
| Process Gas Flow Rate | 80 cubic feet per hour |
| Surface Area, BET, $m^2/gm$ | 4.106 |
| Horiba Data | |
| Horiba mean, microns | 1.005 |
| D10, microns | 0.618 |
| D50, microns | |
| D90, microns | 1.468 |

The molybdenum metal product 12 produced according to this example is characterized by a surface area to mass ratio of 4.106 $m^2/g$ (BET). After grinding to break up agglomerations of the product 12, the non-screened molybdenum metal product 12 had an overall mean size of 1.005 μm, as measured by a Horiba laser scattering analyzer.

It is readily apparent that novel forms of molybdenum metal as discussed herein have a relatively larger surface area to mass ratio and are relatively uniform in size. Likewise, it is apparent that apparatus and methods for production of molybdenum metal discussed herein may be used to produce molybdenum metal in a continuous, single stage manner. Consequently, the claimed invention represents an important development in molybdenum metal technology. Having herein set forth various and preferred embodiments of the invention, it is expected that suitable modifications will be made thereto which will nonetheless remain within the scope of the invention. Accordingly, the invention should not be regarded as limited to the embodiments shown and described herein, and it is intended that the appended claims be construed to include yet other embodiments of the invention, except insofar as limited by the prior art.

What is claimed is:

1. A method for producing molybdenum metal, comprising heating a precursor material to a first temperature in the presence of a reducing gas, said first temperature being in a range of about 540° C. to about 600° C., increasing said first temperature at least once to reduce said precursor material and form said molybdenum metal, and cooling said molybdenum metal at a substantially constant pressure.

2. The method of claim 1, wherein said first temperature is increased to a second temperature in a range of about 760° C. to about 820° C.

3. The method of claim 2, wherein said second temperature is increased to a third temperature in a range of about 980° C. to about 1050° C.

4. The method of claim 1, wherein said first temperature is increased to a second temperature of about 750° C.

5. The method of claim 1, wherein said first temperature is increased to a second temperature in a range of about 750° to about 820° C.

6. The method of claim 5, wherein said second temperature is increased to a third temperature of about 850° C.

7. The method of claim 5, wherein said second temperature is increased to a third temperature in a range of about 850° C. to about 1050° C.

8. A method for producing molybdenum metal, comprising heating a precursor material at a constant pressure to a first temperature in the presence of a reducing gas, said first temperature in a range of about 540° C. to 600° C., and increasing said first temperature at least once to reduce said precursor material and form said molybdenum metal.

9. The method of claim 8, wherein said first temperature is increased to a second temperature in a range of about 760° C. to about 820° C.

10. The method of claim 9, wherein said second temperature is increased to a third temperature in a range of about 980° C. to about 1050° C.

11. The method of claim 8, wherein said first temperature is increased to a second temperature of about 750° C.

12. The method of claim 8, wherein said first temperature is increased to a second temperature in a range of about 750° C. to about 820° C.

13. The method of claim 12, wherein said second temperature is increased to a third temperature of about 850° C.

14. The method of claim 12, wherein said second temperature is increased to a third temperature in a range of about 850° C. to about 1050° C.

* * * * *